US009505994B2

(12) United States Patent
Ovaskainen et al.

(10) Patent No.: US 9,505,994 B2
(45) Date of Patent: Nov. 29, 2016

(54) ANTIFOULANTS FOR USE IN HYDROCARBON FLUIDS

(71) Applicant: BAKER HUGHES INCORPORATED, Houston, TX (US)

(72) Inventors: Ossi V. Ovaskainen, Vantaa (FI); Marco Respini, Casalmorano (IT)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/608,848

(22) Filed: Jan. 29, 2015

(65) Prior Publication Data

US 2015/0218468 A1 Aug. 6, 2015

Related U.S. Application Data

(60) Provisional application No. 61/935,931, filed on Feb. 5, 2014.

(51) Int. Cl.

| | |
|---|---|
| ***C23F 11/04*** | (2006.01) |
| ***C23F 11/06*** | (2006.01) |
| ***B08B 7/00*** | (2006.01) |
| ***B08B 9/00*** | (2006.01) |
| ***C10G 75/04*** | (2006.01) |

(52) U.S. Cl.

CPC ..... *C10G 75/04* (2013.01)

(58) Field of Classification Search

CPC ..... A61L 2/00; B08B 9/00; C07C 11/14
USPC ..... 422/7, 12–17; 134/6, 22.14, 22.16, 134/22.17, 22.19

See application file for complete search history.

(56) References Cited

U.S. PATENT DOCUMENTS

| | | | | |
|---|---|---|---|---|
| 4,410,419 | A | 10/1983 | Ferm | |
| 4,551,226 | A | 11/1985 | Ferm | |
| 5,139,643 | A | 8/1992 | Roling et al. | |
| 5,171,420 | A | 12/1992 | Forester | |
| 5,171,421 | A | 12/1992 | Forester | |
| 5,211,834 | A | 5/1993 | Forester | |
| 7,022,639 | B2 | 4/2006 | Wang et al. | |
| 7,670,984 | B2 | 3/2010 | Wu et al. | |
| 2008/0221271 | A1* | 9/2008 | Duggal et al. | C08F 20/68 525/191 |
| 2010/0017839 | A1 | 1/2010 | Song et al. | |
| 2014/0262953 | A1 | 9/2014 | Ng et al. | |

OTHER PUBLICATIONS

Kunnas, Joni, et al., "Improving residue hydrocracking performance"; www.digital refining.com/article/1000387; PTQQ3 2011, 1-9.

* cited by examiner

*Primary Examiner* — Monzer R Chorbaji
(74) *Attorney, Agent, or Firm* — Mossman, Kumar & Tyler, P.C.

(57) ABSTRACT

An effective amount of at least one antifoulant may be added into a hydrocarbon fluid having at least one potentially fouling causing-component for reducing the fouling by the potentially fouling causing-component(s) as compared to an otherwise identical hydrocarbon fluid absent the antifoulant(s). The hydrocarbon fluid may be present within a location, such as but not limited to an ebullated bed hydrocracking unit feed, a separator, a vacuum distillation column, an atmospheric distillation column, and combinations thereof. The antifoulant(s) may have or include a hydrocarbon backbone attached to at least a first functional group. The hydrocarbon backbone may be or include, but is not limited to, an poly(alpha-olefin), a polyisobutylene, an ethylene-propylene copolymer, a styrene-butadiene copolymer, a polymethyl acrylate, a polyacrylate, and combinations thereof. The first functional group(s) may be polar functional group(s).

16 Claims, 1 Drawing Sheet

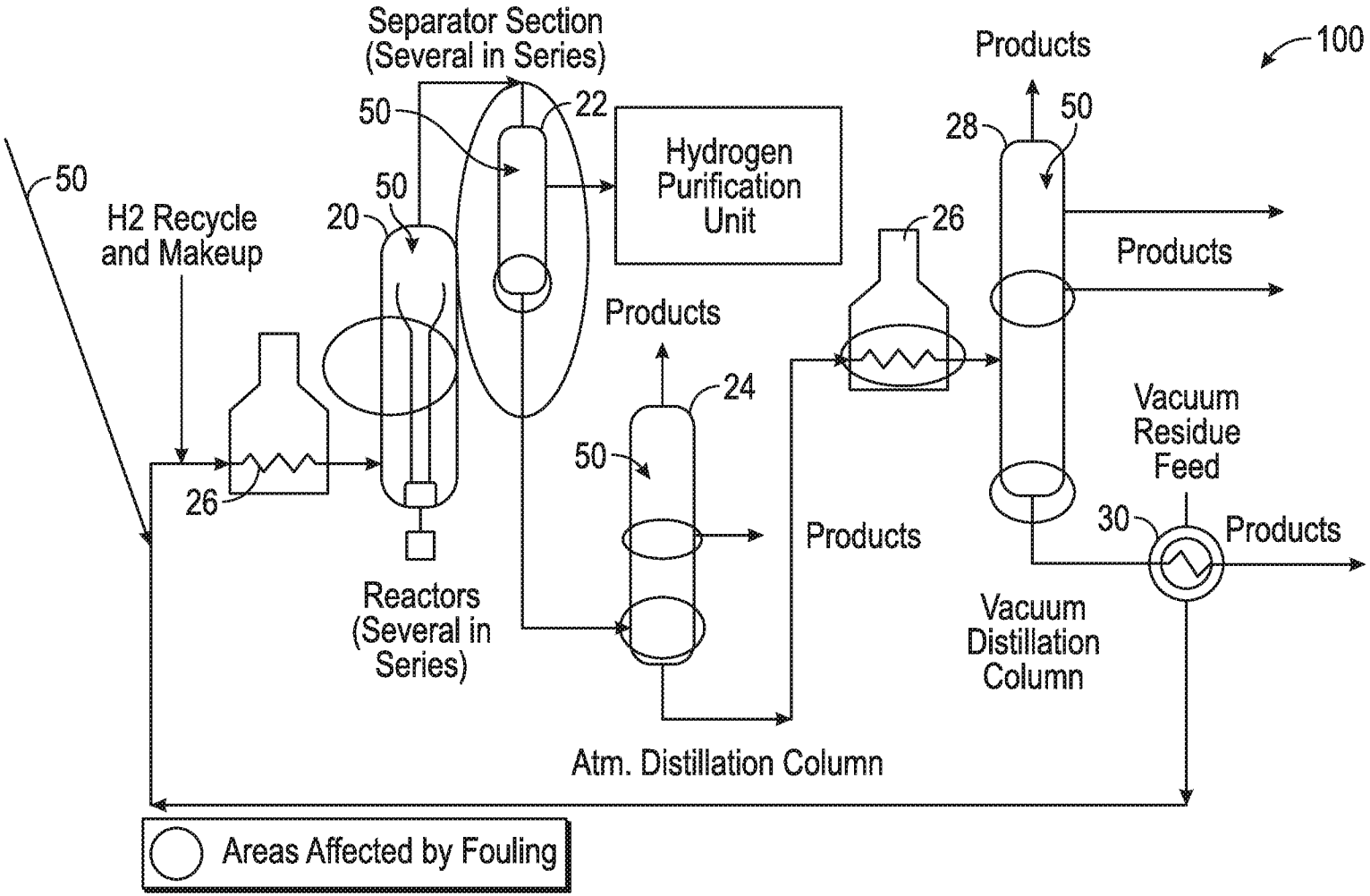
100
Products
50
28
Products
Vacuum Residue Feed
Products
30
Vacuum Distillation Column
26
Products
Hydrogen Purification Unit
Products
24
50
Atm. Distillation Column
Separator Section (Several in Series)
22
50
50
20
Reactors (Several in Series)
H2 Recycle and Makeup
26
50
Areas Affected by Fouling

ANTIFOULANTS FOR USE IN HYDROCARBON FLUIDS

CROSS-REFERENCE TO RELATED APPLICATION

This application claims the benefit of Provisional Patent Application No. 61/935,931 filed Feb. 5, 2014, which is incorporated by reference herein in its entirety.

TECHNICAL FIELD

The present invention relates to methods and compositions for adding an effective amount of at least one antifoulant into a hydrocarbon fluid having at least one potentially fouling causing-component, and more specifically relates to hydrocarbon fluids upstream from, within, and/or downstream from an ebullated bed hydrocracking unit.

BACKGROUND

As the price or shortage of high quality crude oil increases, there will be an ever-increasing demand to find ways to better exploit lower quality feedstocks and extract fuel values therefrom. Lower quality feedstocks may have relatively high quantities of potentially-fouling causing components, such as asphaltenes, coke, and coke pre-cursors, which are difficult to process and commonly cause fouling of conventional catalysts and hydroprocessing equipment. As more economical ways to process lower quality feedstocks become available, such feedstocks may possibly catch, or even surpass, higher quality crude oils, in the not-too-distant future, as the primary source of refined fossil fuels used to operate automobiles, trucks, farm equipment, aircraft, and other vehicles that rely on internal combustion.

Hydrocracking is used in the petroleum industry to process crude oil and/or other petroleum products for commercial use by preventing or inhibiting the fouling by the potentially fouling-causing components. Hydrocracking is a catalytic cracking process using an elevated partial pressure of hydrogen gas to purify the hydrocarbon stream. Ebullated-bed hydrocracking is one type of hydrocracking that may be used for resid conversion, and the ebullated-bed hydrocrackers may have a continuous addition and/or removal of catalysts. However, hydrocracking is subject to asphaltene precipitation as the saturates and aromatics contained in the hydrocarbon fluid that hold the asphaltenes in solution are removed or converted, which is driven by asphaltene-solubility chemistry. Fouling may occur downstream from the ebullated bed hydrocracker reactor, such as in bottom stream areas, atmospheric column bottoms, vacuum-column bottoms, vacuum-column furnaces, high- and mid-pressure separators, and the like. Extensive fouling may result in unplanned shutdowns, downtime and lost production and consequently increased operating costs.

Conversion reaction rates (thermal cracking), leading to fouling by asphaltenes decomposition, increase more rapidly with rising temperatures compared to the hydrogen-saturation reactions that inhibit sediment formation. Accordingly, temperatures and conversions above pre-determined limits may lead to uncontrolled sediments and coke generation. However, operating below the pre-determined limits only results in lost conversion with no major advantages in terms of sediment deposition control and run lengths.

Asphaltenes are most commonly defined as that portion of petroleum, which is soluble in xylene and toluene, but insoluble in heptane or pentane. Asphaltenes exist in crude oil as both soluble species and in the form of colloidal dispersions stabilized by other components in the crude oil. Asphaltenes have higher molecular weights and are the more polar fractions of crude oil, and can precipitate upon pressure, temperature, and compositional changes in crude oil resulting from blending or other mechanical or physico-chemical processing. Asphaltene precipitation and deposition can cause problems in subterranean reservoirs, upstream production facilities, mid-stream transportation facilities, refineries, and fuel blending operations. In petroleum production facilities, asphaltene precipitation and deposition can occur in near wellbore reservoir regions, wells, flowlines, separators, and other equipment. Once deposited, asphaltenes present numerous problems for crude oil producers. For example, asphaltene deposits can plug downhole tubulars, wellbores, choke off pipes and interfere with the functioning of safety shut-off valves, and separator equipment. Asphaltenes have caused problems in refinery processes such as desalters, distillation preheat units, and cokers.

In addition to carbon and hydrogen in the composition, asphaltenes may contain nitrogen, oxygen and sulfur species, and may also contain metal species such as nickel, vanadium, and iron. Typical asphaltenes are known to have different solubilities in the formation fluid itself or in certain solvents like carbon disulfide or aromatic solvents, such as benzene, toluene, xylene, and the like. However, the asphaltenes are insoluble in solvents like paraffinic compounds, including but not limited to pentane, heptane, octane, etc. Asphaltene stability can even be disturbed by mixing hydrocarbon-based fluids i.e. such as mixing two types of crude oils together, two types of shale oils together, condensates, and others, of different origins at certain ratios as the chemistry of the hydrocarbon-based fluids from different sources may be incompatible and induce destabilization of the asphaltenes therein. In non-limiting examples, such as during refining or fuel blending, two or more hydrocarbon-based fluids may be mixed together. Sometimes, changes in physical conditions are sufficient to induce destabilization, or even the mixture of different hydrocarbon-based fluids that have incompatible chemistries. Said differently, even if neither hydrocarbon-based fluid, alone, has destabilized foulants or the hydrocarbon-based fluid would not act as a destabilizing additive by itself, the mixing or the mixture of two or more hydrocarbon-based fluids may destabilize the foulants present in either hydrocarbon-based fluid.

Coke is an insoluble organic portion of crude oil, distillation residua, or residua from thermal/catalytic conversion processes, such as including but not limited to visbreaker tar or LC finer/H oil residuum. Coke may have polyaromatic hydrocarbons (PAHs) dispersed therein with a ring structure of about 4 to about 5 or more condensed aromatic rings.

Coke precursors are the fragments that make up the coke. They are often formed by thermal cracking, dealkylation and/or dehydrogenation processes commonly used for the breaking down of complex organic molecules. They are barely soluble in the crude oil and/or residual, but they tend to precipitate. Once they precipitate, the coke precursors tend to polymerize or conglomerate and form coke.

Accordingly, there are large incentives to mitigate fouling during refining. There are large costs associated with shutting down production units because of the fouling components within, as well as the cost to clean the units. The foulants may create an insulating effect within the production unit, reduce the efficiency and/or reactivity, and the like.

In either case, reducing the amount of fouling would reduce the cost to produce hydrocarbon fluids and the products derived therefrom.

There is an ongoing need to prevent or inhibit the fouling by the potentially fouling-causing components in a hydrocarbon fluid.

SUMMARY

There is provided, in one form, a method for adding an effective amount of at least one antifoulant into a hydrocarbon fluid at a location, such as directly into an ebullated bed hydrocracking unit fluid, into a separator, into a vacuum distillation column, into an atmospheric distillation column, and combinations thereof. The hydrocarbon fluid may have or include at least one potentially fouling causing-component. The antifoulant(s) may have a hydrocarbon backbone and at least a first functional group where the hydrocarbon backbone may be or include a poly(alpha-olefin), a polyisobutylene, an ethylene-propylene copolymer, a styrene-butadiene copolymer, a polymethyl acrylate, a polyacrylate, and combinations thereof. The first functional group(s) may be polar functional group(s). The method may further include reducing the fouling by the potentially fouling causing-component(s) within the hydrocarbon fluid as compared to an otherwise identical hydrocarbon fluid absent the antifoulant(s).

There is further provided in another non-limiting embodiment the method as described above where the antifoulant(s) may be or include polyisobutylene succinic anhydride, polyalkylene maleic anhydride copolymers, polyalkylene succinimides, polyalkylene succinate esters, polyalkylene phosphonic acids, polyalkylene thiophosphonic acids, polyalkylene thiophosphonic esters, polyalkylene phosphonate esters, polyalkylene phenols, polyalkylene dodecylbenzene sulfonic acid, ammonia neutralized dodecylbenzene sulphonic acid, alkylaryl sulphonic acids, tall oil imidazoline, alkylamide-imidazolines, magnesium oxide overbase, carbonated magnesium oxide overbase, fatty esters of polyhydric alcohols, fatty acid amides, fatty acid amides ethoxylates, alkylphenol/aldehyde resins, a reaction product between a fatty acid and an amine, a reaction product between a fatty acid and a polyamine, a sterically-hindered phenol, a nonylphenol, an ethoxy-propoxylated phenol, a formaldehyde resin, a phenol-formaldehyde resin, a reaction product between a sterically-hindered phenol with an amine, a reaction product between a sterically-hindered phenol with a polyamine, a reaction product between a sterically-hindered phenol with an imidazoline, and combinations thereof.

In an alternative non-limiting embodiment, a treated fluid composition is provided. The treated fluid composition may have or include a hydrocarbon fluid having at least one potentially fouling-causing component, and at least one antifoulant having a hydrocarbon backbone and at least a first functional group. The hydrocarbon backbone may be or include a poly(alpha-olefin), a polyisobutylene, an ethylene-propylene copolymer, a styrene-butadiene copolymer, a polymethyl acrylate, a polyacrylate, and combinations thereof. The hydrocarbon fluid may be present within a location, such as but not limited to, an ebullated bed hydrocracking unit feed, a separator, a vacuum distillation column, an atmospheric distillation column, and combinations thereof. The first functional group(s) may be polar functional group(s). The treated fluid composition may have a reduced amount of fouling by the potentially fouling-causing component(s) as compared to an otherwise identical hydrocarbon fluid absent the antifoulant(s).

In a non-limiting embodiment of the treated fluid composition, the antifoulant(s) may be present in the hydrocarbon fluid in an amount ranging from about 1 ppm to about 10,000 ppm based on the total amount of the hydrocarbon fluid. The antifoulant(s) may be or include a polyisobutylene succinic anhydride, polyalkylene maleic anhydride copolymers, polyalkylene succinimides, polyalkylene succinate esters, polyalkylene phosphonic acids, polyalkylene thiophosphonic acids, polyalkylene thiophosphonic esters, polyalkylene phosphonate esters, polyalkylene phenols, polyalkylene dodecylbenzene sulfonic acid, ammonia neutralized dodecylbenzene sulphonic acid, alkylaryl sulphonic acids, tall oil imidazoline, alkylamide-imidazolines, magnesium oxide overbase, carbonated magnesium oxide overbase, fatty esters of polyhydric alcohols, fatty acid amides, fatty acid amides ethoxylates, alkylphenol/aldehyde resins, a reaction product between a fatty acid and an amine, a reaction product between a fatty acid and a polyamine, a sterically-hindered phenol, a reaction product between a sterically-hindered phenol with an amine, a reaction product between a sterically-hindered phenol with a polyamine, a reaction product between a sterically-hindered phenol with an imidazoline, and combinations thereof.

The antifoulant(s) appear to reduce the amount of fouling by the potentially fouling-causing component(s) as compared to an otherwise identical hydrocarbon fluid absent the antifoulant(s).

BRIEF DESCRIPTION OF THE DRAWING

FIG. 1 is a non-limiting flow of a hydrocarbon fluid illustrating the various points where an antifoulant may be added in accordance with the methods described herein.

DETAILED DESCRIPTION

It has been discovered that an effective amount of at least one antifoulant may be added into a hydrocarbon fluid having at least one potentially fouling causing-component. The fouling-causing component(s) may be or include, but are not limited to, asphaltenes, coke precursors, coke, and combinations thereof. The antifoulant may prevent or inhibit the fouling by the potentially fouling causing-component(s) therein as compared to an otherwise identical hydrocarbon fluid absent the antifoulant(s). In one non-limiting embodiment, the antifoulant(s) may increase the dispersion of asphaltenes, coke precursors, and/or coke within the hydrocarbon fluid. Use of the dispersant/antifoulant may be dosed into the hydrocracking fluid and reduce the aggregation and/or precipitation of the potentially fouling-causing components. The dispersed potentially fouling-causing components, such as the free radical fragments of asphaltenes, may be more easily hydrogenated/saturated by the catalyst in an ebullated bed hydrocracking reactor in one non-limiting embodiment.

The fouling-causing components may or may not already exist in the hydrocarbon fluid prior to residue cracking (e.g. hydrocracking) of the hydrocarbon fluid. In one non-limiting example, asphaltenes may crack and polymerize during the reaction process of hydrocracking. Thus, whether the asphaltenes are present in the hydrocarbon fluid before or after hydrocracking, the asphaltenes may precipitate, or the asphaltenes may form into coke precursors and possibly coke.

The hydrocarbon fluid may be a still fluid, or it may be part of a hydrocarbon feed or hydrocarbon fluid; 'hydrocarbon fluid' is defined herein to include both. Non-limiting examples of the hydrocarbon fluid may be or include a crude oil, a refinery fluid, and mixtures thereof. 'Crude oil' as used herein includes water-in-crude emulsions, a fluid that is only crude oil, and mixtures thereof.

'Inhibit' is defined herein to mean that the antifoulant(s) may suppress or reduce the amount of total fouling by the fouling-causing components within the hydrocarbon fluid, assuming there are fouling-causing components present within the fluid. That is, it is not necessary for fouling to be entirely prevented for the methods and compositions discussed herein to be considered effective, although complete prevention is a desirable goal. Moreover, the fouling by the potentially fouling-causing components may be prevented or inhibited by reducing the ability of the potentially fouling-causing components from polymerizing or otherwise agglomerating, reducing the ability of the potentially fouling-causing components to form deposits or precipitates, and the like.

The antifoulant(s) may be added to the hydrocarbon stream at a location, such as but not limited to, upstream from or directly into an ebullated bed hydrocracking unit (e.g. an LC finer or H-oil reactor), into an interstage separator, into an vacuum distillation unit, into an atmospheric distillation units, and combinations thereof. The antifoulant(s) may be added into the hydrocarbon fluid by adding the antifoulant(s) into a distillate fluxant blended with a distillate residua feed, adding the antifoulant(s) into the hydrocracking unit feed by a connected feed line, and combinations thereof. The antifoulant(s) may be added into the hydrocarbon fluid at a pre-determined rate, which may be a continuous rate, an intervallic rate, and combinations thereof. 'Distillate fluxant' is used herein to refer to an atmospheric or vacuum distillation cut or distillate from a conversion process, such as but not limited to gasoline, kerosene, gas oil, vacuum gas oil, visbreaker gas oil, FCC light cycle oil, FCC slurry oil, and the like.

The term "hydrocracking" is defined herein to mean a process where the primary purpose is to reduce the boiling range of a heavy oil feedstock and where a substantial portion of the feedstock is converted into products with boiling ranges lower than that of the original feedstock. Hydrocracking generally involves fragmentation of larger hydrocarbon molecules into smaller molecular fragments having a fewer number of carbon atoms and a higher hydrogen-to-carbon ratio. Hydrocracking may involve the formation of hydrocarbon free radicals during fragmentation, which may be followed by capping the free radical ends or moieties with hydrogen. The hydrogen atoms or radicals that react with hydrocarbon free radicals during hydrocracking may be generated at or by active catalyst sites of an ebullated bed hydrocracking unit.

The antifoulant(s) may have or include a hydrocarbon backbone attached to at least a first functional group. The hydrocarbon backbone may be or include, but is not limited to, a poly(alpha-olefin), a polyisobutylene, an ethylene-propylene copolymer, a styrene-butadiene copolymer, a polymethyl acrylate, a polyacrylate, and combinations thereof. In a non-limiting instance, the first functional group may be a polar group, such as but not limited to, a succinimide, a succinic anhydride, a phenol, a phosphonate, and combinations thereof. 'First functional group' is defined herein as a functional group that is directly attached to the hydrocarbon backbone; there may be one 'first functional group' attached to the hydrocarbon backbone, or there may be more than one 'first functional group' attached depending on the target foulant and operating conditions of the hydrocarbon fluid.

In another non-limiting embodiment, the antifoulant may also have or include at least an optional second functional group attached to the first functional group. The second functional group may be a polar group and may allow the antifoulant to further prevent or inhibit the fouling by the potentially fouling-causing components in the absence of a polar first functional group. In other words, the second functional group may be less optional when the first functional group is not a polar functional group. Non-limiting examples of the second functional group may be or include, but are not limited to, an alcohol, an amine, a polyalcohol, a polyamine, and combinations thereof. A 'second' functional group is defined herein as a functional group that is directly attached to at least one first functional group; there may only be one 'second functional group' attached to one or more first functional group(s), or there may be more than one 'second functional group' attached to one or more first functional group(s) depending on the targeted foulant and operating conditions of the hydrocarbon fluid.

Non-limiting examples of the antifoulant(s) may be or include, but are not limited to, polyisobutylene succinic anhydride, polyalkylene maleic anhydride copolymers, polyalkylene succinimides, polyalkylene succinate esters, polyalkylene phosphonic acids, polyalkylene thiophosphonic acids, polyalkylene thiophosphonic esters, polyalkylene phosphonate esters, polyalkylene phenols, polyalkylene dodecylbenzene sulfonic acid, ammonia neutralized dodecylbenzene sulphonic acid, alkylaryl sulphonic acids, tall oil imidazoline, alkylamide-imidazolines, magnesium oxide overbase, carbonated magnesium oxide overbase, fatty esters of polyhydric alcohols, fatty acid amides, fatty acid amides ethoxylates, alkylphenol/aldehyde resins, a sterically-hindered phenol, a reaction product between a fatty acid and an amine, a reaction product between a fatty acid and a polyamine, a reaction product between a sterically-hindered phenol with an amine, a reaction product between a sterically-hindered phenol with a polyamine, a reaction product between a sterically-hindered phenol with an imidazoline, and combinations thereof. Non-limiting examples of such reaction products may be or include BHT (butylhydroxyltoluene or also known as di-tert-butyl-4-methylphenol) with ammonia, BHT with di-ethylene-triamine, BHT with tall oil imidazoline, and mixtures thereof.

'Magnesium oxide overbase' as used herein refers to where the amount of base is more than the amount of metal within the antifoulant. For example, when a magnesium oxide overbase is used within the additive, the amount of oxide is lower than the amount of magnesium to form the overbase. The overbase refers to compounds with a great capacity of neutralizing acids. The magnesium oxide overbase may be prepared in any manner known to those of ordinary skill in the art.

Non-limiting examples of a sterically-hindered phenol may be or include, but are not limited to, a nonylphenol, an ethoxy-propoxylated phenol, a formaldehyde resin, a phenol-formaldehyde resin, butylhydroxyltoluene, and mixtures thereof. Non-limiting examples of the fatty acid for purposes of reacting the fatty acid with an amine or polyamine to create the antifoulant(s) may be or include, but are not limited to, tall oil fatty acids, lauric fatty acids, oleic fatty acids, palmitic fatty acids, stearic fatty acids, and combinations thereof. A non-limiting example of the amine for purposes of reacting the amine with a fatty acid, or a sterically-hindered phenol to create the antifoulant(s) may be or include, but is not limited to, ammonia. Non-limiting examples of the polyamines for purposes of reacting the polyamine with a fatty acid, or a sterically-hindered phenol to create the antifoulant(s) may be or include, but are not limited to, di-ethylene-triamine, imidazoline, and combinations thereof.

The effective amount of the antifoulant(s) is difficult to predict in advance because it would depend on the particular hydrocarbon fluid, the type of targeted foulant, the operating conditions (e.g. temperature), and the like. However, in one non-limiting embodiment, the effective amount of the antifoulant(s) may range from about 1 ppm independently to about 10,000 ppm based on the total hydrocarbon fluid. Alternatively, the amount of the antifoulant(s) may range from about 10 ppm independently to about 1,000 ppm, or from about 50 ppm independently to about 300 ppm in another non-limiting embodiment. As used herein with respect to a range, "independently" means that any lower threshold may be used together with any upper threshold to give a suitable alternative range.

The operating conditions of the hydrocarbon fluid may require the temperature, pressure, and the like to be within a particular range. In a non-limiting example, the temperature of the hydrocarbon fluid may range from about 25° C. independently to about 500° C., alternatively from about 50° C. independently to about 250° C. The pressure surrounding the hydrocarbon fluid may range from about 0 bars (0 kPa) independently to about 250 bars (approximately 25,000 kPa) alternatively from about 10 bars (1,000 kPa) independently to about 200 bars (approximately 20,000 kPa).

Now turning to the Figures, FIG. 1 is a non-limiting flow 100 of a hydrocracking fluid illustrating the various points where the antifoulant may be added; an arrow 50 represents each location. The antifoulant may be added at any one or any combination of these locations. The hydrocarbon fluid may pass through at least one reactor 20, a separator section 22, an atmospheric distillation column 24, a vacuum heater 26, and a vacuum distillation column 28. At the point of the separator 22, the hydrocarbon fluid may exit the flow 100 into the hydrogen purification unit, or the hydrocarbon fluid may continue on to the atmospheric distillation unit 24. The hydrocarbon fluid may exit the atmospheric distillation column 24 as a product, or the hydrocarbon fluid may continue on to the vacuum heater 26 and the vacuum distillation column 28. The vacuum distillation column 28 may produce a vacuum distillation column feed 30 that may either exit the flow 100 as a product, or the hydrocarbon fluid may pass through the non-limiting flow 100 again. The antifoulant may be dosed or injected into a distillate fluxant blended with a distillate residua feed, added into the vacuum distillation unit 28, added into the atmospheric distillation unit 26, dosed upstream from or directly into the reactor(s) 20, added into the separator 22, and combinations thereof.

In the foregoing specification, the invention has been described with reference to specific embodiments thereof, and has been described as effective in providing methods and compositions for reducing the fouling by potentially fouling causing-components within a hydrocarbon fluid. However, it will be evident that various modifications and changes can be made thereto without departing from the broader spirit or scope of the invention as set forth in the appended claims. Accordingly, the specification is to be regarded in an illustrative rather than a restrictive sense. For example, specific antifoulants, first functional groups, second functional groups, hydrocarbon backbones, and locations within a hydrocarbon fluid falling within the claimed parameters, but not specifically identified or tried in a particular composition or method, are expected to be within the scope of this invention.

The present invention may suitably comprise, consist or consist essentially of the elements disclosed and may be practiced in the absence of an element not disclosed. For instance, the method may consist of or consist essentially of adding an effective amount of at least one antifoulant into a hydrocarbon fluid having at least one potentially fouling-causing component at a location selected from the group consisting of an ebullated bed hydrocracking unit feed, a separator, a vacuum distillation column, an atmospheric distillation column, and combinations thereof, and reducing the fouling by the potentially fouling causing-component(s) within the hydrocarbon fluid as compared to an otherwise identical hydrocarbon fluid absent the antifoulant(s); the antifoulant(s) may have a hydrocarbon backbone and at least a first functional group where the hydrocarbon backbone may be or include a poly(alpha-olefin), a polyisobutylene, an ethylene-propylene copolymer, a styrene-butadiene copolymer, a polymethyl acrylate, a polyacrylate, and combinations thereof; the first functional group(s) may be polar functional group(s).

The treated fluid composition may suitably comprise, consist or consist essentially of a hydrocarbon fluid having at least one potentially fouling-causing component, and at least one antifoulant having a hydrocarbon backbone and at least a first functional group; wherein the hydrocarbon fluid is present within a location selected from the group consisting of an ebullated bed hydrocracking unit feed, a separator, a vacuum distillation column, an atmospheric distillation column, and combinations thereof; the treated fluid composition may have a reduced amount of fouling by the potentially fouling-causing component(s) as compared to an otherwise identical hydrocarbon fluid absent the antifoulant(s); the hydrocarbon backbone may be or include an poly(alpha-olefin), a polyisobutylene, an ethylene-propylene copolymer, a styrene-butadiene copolymer, a polymethyl acrylate, a polyacrylate, and combinations thereof. The first functional group(s) may be polar functional group(s).

The words "comprising" and "comprises" as used throughout the claims, are to be interpreted to mean "including but not limited to" and "includes but not limited to", respectively.

What is claimed is:

1. A method comprising:

adding an effective amount of at least one antifoulant into a hydrocarbon fluid at a location selected from the group consisting of directly into an ebullated bed hydrocracking unit feed, into a separator, into a vacuum distillation column, into an atmospheric distillation column, and combinations thereof; wherein the hydrocarbon fluid comprises at least one potentially fouling causing-component; wherein the at least one antifoulant comprises a hydrocarbon backbone and at least a first functional group; wherein the hydrocarbon backbone is selected from the group consisting of a poly (alpha-olefin), a polyisobutylene, an ethylene-propylene copolymer, a styrene-butadiene copolymer, a polyacrylate, and combinations thereof; wherein the at least first functional group is a polar group, wherein the at least one antifoulant is selected from the group consisting of polyisobutylene succinic anhydride, polyalkylene maleic anhydride copolymers, polyalkylene succinate esters, polyalkylene phosphonic acids, polyalkylene thiophosphonic acids, polyalkylene thiophosphonic esters, polyalkylene phosphonate esters, polyalkylene phenols, polyalkylene dodecylbenzene sulfonic acid, ammonia neutralized dodecylbenzene sulphonic acid, alkylaryl sulphonic acids, tall oil imidazoline, alkylamide-imidazolines, magnesium oxide overbase, carbonated magnesium oxide overbase, fatty acid amides ethoxylates, alkylphenol/aldehyde resins, a sterically-hindered phenol, a nonylphenol, an ethoxy-propoxylated phenol, a formaldehyde resin, a phenol-formaldehyde resin, a reaction product between a sterically-hindered phenol with an amine, a reaction product between a sterically-hindered phenol with a polyamine, a reaction product between a sterically-hindered phenol with an imidazoline, and combinations thereof; and reducing the fouling by the at least one potentially fouling causing-component within the hydrocarbon fluid as compared to an otherwise identical hydrocarbon fluid absent the at least one antifoulant.

2. The method of claim 1, wherein the at least first functional group is selected from the group consisting of a succinimide, a succinic anhydride, a phenol, a phosphonate, and combinations thereof.

3. The method of claim 1, wherein the at least one antifoulant further comprises at least one second functional group attached to the at least first functional group; and wherein the at least one second functional group is selected from the group consisting of an alcohol, an amine, a polyalcohol, a polyamine, and combinations thereof.

4. The method of claim 1, wherein the effective amount of the at least one antifoulant ranges from about 1 ppm to about 10,000 ppm based on the total amount of the hydrocarbon fluid.

5. The method of claim 1, wherein the adding occurs by adding the at least one antifoulant into a distillate fluxant blended with a distillate residua feed.

6. The method of claim 1, wherein the adding the at least one antifoulant occurs at a rate selected from the group consisting of a continuous rate, an intervallic rate, and combinations thereof.

7. The method of claim 1, wherein the at least one fouling-causing component is selected from the group consisting of asphaltenes, coke precursors, coke, and combinations thereof.

8. The method of claim 1 where the location selected from the group consisting of directly into an ebullated bed hydrocracking unit feed, into a vacuum distillation column, into an atmospheric distillation column, and combinations thereof.

9. A method comprising:

adding an effective amount of at least one antifoulant into a hydrocarbon fluid at a location selected from the group consisting of upstream from an ebullated bed hydrocracking unit feed, directly into an ebullated bed hydrocracking unit feed, into a vacuum distillation column, into an atmospheric distillation column, and combinations thereof; wherein the hydrocarbon fluid comprises at least one potentially fouling-causing component; wherein the at least one antifoulant is selected from the group consisting of polyisobutylene succinic anhydride, polyalkylene maleic anhydride copolymers, polyalkylene succinimides, polyalkylene succinate esters, polyalkylene phosphonic acids, polyalkylene thiophosphonic acids, polyalkylene thiophosphonic esters, polyalkylene phosphonate esters, polyalkylene phenols, polyalkylene dodecylbenzene sulfonic acid, ammonia neutralized dodecylbenzene sulphonic acid, alkylaryl sulphonic acids, tall oil imidazoline, alkylamide-imidazolines, magnesium oxide overbase, carbonated magnesium oxide overbase, fatty acid amides ethoxylates, alkylphenol/aldehyde resins, a sterically-hindered phenol, a nonylphenol, an ethoxy-propoxylated phenol, a formaldehyde resin, a phenol-formaldehyde resin, a reaction product between a sterically-hindered phenol with an amine, a reaction product between a sterically-hindered phenol with a polyamine, a reaction product between a sterically-hindered phenol with an imidazoline, and combinations thereof; and reducing the fouling by the at least one potentially fouling causing-component within the hydrocarbon fluid as compared to an otherwise identical hydrocarbon fluid absent the at least one antifoulants;

wherein the at least one fouling-causing component is selected from the group consisting of asphaltenes, coke precursors, coke, and combinations thereof.

10. The method of claim 9, wherein the effective amount of the at least one antifoulant ranges from about 1 ppm to about 10,000 ppm based on the total amount of the hydrocarbon fluid.

11. A treated fluid composition comprising:

a hydrocarbon fluid comprising at least one potentially fouling-causing component; wherein the hydrocarbon fluid is present within a location selected from the group consisting of an ebullated bed hydrocracking unit feed, a separator, a vacuum distillation column, an atmospheric distillation column, and combinations thereof;

at least one antifoulant comprising a hydrocarbon backbone and at least a first functional group; wherein the hydrocarbon backbone is selected from the group consisting of an poly(alpha-olefin), a polyisobutylene, an ethylene-propylene copolymer, a styrene-butadiene copolymer, a polyacrylate, and combinations thereof; wherein the at least first functional group is a polar group, wherein the at least one antifoulant is selected from the group consisting of polyisobutylene succinic anhydride, polyalkylene maleic anhydride copolymers, polyalkylene succinate esters, polyalkylene phosphonic acids, polyalkylene thiophosphonic acids, polyalkylene thiophosphonic esters, polyalkylene phosphonate esters, polyalkylene phenols, polyalkylene dodecylbenzene sulfonic acid, ammonia neutralized dodecylbenzene sulphonic acid, alkylaryl sulphonic acids, tall oil imidazoline, alkylamide-imidazolines, magnesium oxide overbase, carbonated magnesium oxide overbase, fatty acid amides ethoxylates, alkylphenol/aldehyde resins, a sterically-hindered phenol, a nonylphenol, an ethoxy-propoxylated phenol, a formaldehyde resin, a phenol-formaldehyde resin, a reaction product between a sterically-hindered phenol with an amine, a reaction product between a sterically-hindered phenol with a polyamine, a reaction product between a sterically-hindered phenol with an imidazoline, and combinations thereof; and wherein the treated fluid composition comprises a reduced amount of fouling by the at least one potentially fouling-causing component as compared to an otherwise identical hydrocarbon fluid absent the at least one antifoulant.

12. The composition of claim 11, wherein the at least first functional group is selected from the group consisting of a succinimide, a succinic anhydride, a phenol, a phosphonate, and combinations thereof.

13. The composition of claim 11, wherein the at least one antifoulant further comprises at least one second functional group attached to the at least first functional group; and wherein the at least one second functional group is selected from the group consisting of an alcohol, an amine, a polyalcohol, a polyamine, and combinations thereof.

14. The composition of claim 11, wherein the at least one antifoulant is present within the treated fluid composition in an amount ranging from about 1 ppm to about 10,000 ppm based on the total amount of the hydrocarbon fluid.

15. The composition of claim 11, wherein the at least one fouling-causing component is selected from the group consisting of asphaltenes, coke precursors, coke, and combinations thereof.

16. A treated fluid composition comprising:

a hydrocarbon fluid comprising at least one potentially fouling-causing component; wherein the hydrocarbon fluid is present within a location selected from the group consisting of an ebullated bed hydrocracking unit feed, a separator, a vacuum distillation column, an atmospheric distillation column, and combinations thereof;

at least one antifoulant in an amount ranging from about 1 ppm to about 10,000 ppm based on the total amount of the hydrocarbon fluid; wherein the at least one antifoulant is selected from the group consisting of a polyisobutylene succinic anhydride, polyalkylene maleic anhydride copolymers, polyalkylene succinate esters, polyalkylene phosphonic acids, polyalkylene thiophosphonic acids, polyalkylene thiophosphonic esters, polyalkylene phosphonate esters, polyalkylene phenols, polyalkylene dodecylbenzene sulfonic acid, ammonia neutralized dodecylbenzene sulphonic acid, alkylaryl sulphonic acids, tall oil imidazoline, alkylamide-imidazolines, magnesium oxide overbase, carbonated magnesium oxide overbase, fatty acid amides ethoxylates, alkylphenol/aldehyde resins, a sterically-hindered phenol, a reaction product between a sterically-hindered phenol with an amine, a reaction product between a sterically-hindered phenol with a polyamine, a reaction product between a sterically-hindered phenol with an imidazoline, and combinations thereof; and wherein the treated fluid composition comprises a reduced amount of fouling by the at least one potentially fouling-causing component as compared to an otherwise identical hydrocarbon fluid absent the at least one antifoulants;

wherein the at least one fouling-causing component is selected from the group consisting of asphaltenes, coke precursors, coke, and combinations thereof.

* * * * *